United States Patent [19]

Rippstein

[11] 3,967,891

[45] July 6, 1976

[54] IMAGING SYSTEM FOR ELECTROSTATIC REPRODUCTION MACHINES

[75] Inventor: Robert P. Rippstein, Rochester, N.Y.

[73] Assignee: Xerox Corporation, Stamford, Conn.

[22] Filed: Apr. 14, 1975

[21] Appl. No.: 567,902

[52] U.S. Cl. ..... 355/3 R; 96/1 C; 317/262 A

[51] Int. Cl.[2] ..... G03G 15/00

[58] Field of Search ..... 355/3 R, 3 CH, 14, 17; 96/1 C; 317/262 A

[56] References Cited

UNITED STATES PATENTS 3,532,494 10/1970 Bhagat ..... 355/3 CH 3,540,806 11/1970 Starkweather ..... 355/17 X

*Primary Examiner*—R. L. Moses

[57] ABSTRACT

Electrostatic type copying apparatus incorporating an arrangement to control the electrostatic developing field to enhance reproduction of half-tone images. The control arrangement has an electrostatic field effect neutralizer effective to release neutralizing electrons in response to image charge conditions. Grid control and/or housing bias are employed to regulate the discharge and quantity of ions available.

6 Claims, 3 Drawing Figures

IMAGING SYSTEM FOR ELECTROSTATIC REPRODUCTION MACHINES

This invention relates to electrostatic type reproduction machines, and more particularly to electrostatic type reproduction machines having means for controlling the electrostatic developing field to enhance halftone image reproduction.

In electrostatic reproduction machines or copiers, solid area development often presents a problem. In the copying process, the machine photoconductor, which has been previously uniformly charged in preparation for imaging, is exposed to a light image of the original being copied, such exposure discharging in varying degrees and in accordance with the light image, the previously charged photoconductor creating thereby an electrostatic latent image of the original on the surface of the photoconductor. In this process of reproduction, the creation of high electric fields at the boundaries between charged and uncharged areas of the photoconductor surface appears to be primarily responsible for the electrostatic system's inability to reproduce large areas of solid dark color. The result is often seen as a large solid area with washed out or weakly colored center.

The problem rests on the fact that the developing agent, toner, is attracted principally to the areas of the photoconductor having the greatest electric field. In the case of solid areas, this is the edge or border portions, which due to voltage differentials, tend to have a charge higher than the interior of the solid area.

It is a principle object of the present invention to provide a new and improved electrostatic reproduction apparatus.

It is an object of the present invention to reduce selectively the electric fields in image edge areas to reduce solid area washout.

It is an object of the present invention to improve electrostatic image quality.

It is an object of the present invention to provide an arrangement for reducing selected charge areas of a latent electrostatic image and thereby reduce the amount of developing toner attracted thereto without weakening image resolution.

It is an object of the present invention to neutralize excessive charges comprising a latent electrostatic image and prevent undesired over development.

This invention relates to an electrostatic reproduction machine comprising, in combination, a photoconductive member, charging means to charge the photoconductive member in preparation for imaging, means to expose the charged photoconductive member to form a latent electrostatic image on the photoconductive member, means forming a reservoir of ions carrying a charge opposite to the charge on the photoconductive member from the charging means, oppositely charged ions remaining on the photoconductive member tending to attract ions from the reservoir in accordance with the charge differential therebetween, and control gate means for regulating the rate of discharge of the ions from the reservoir.

Figure 1:
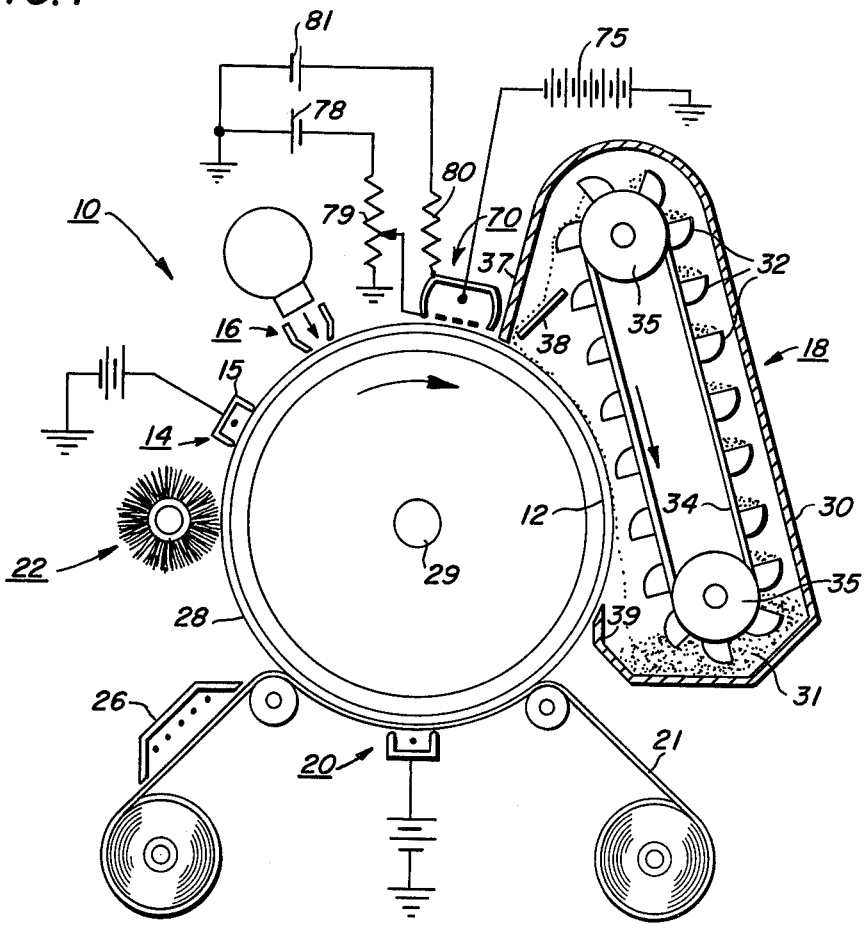
Figure 2:
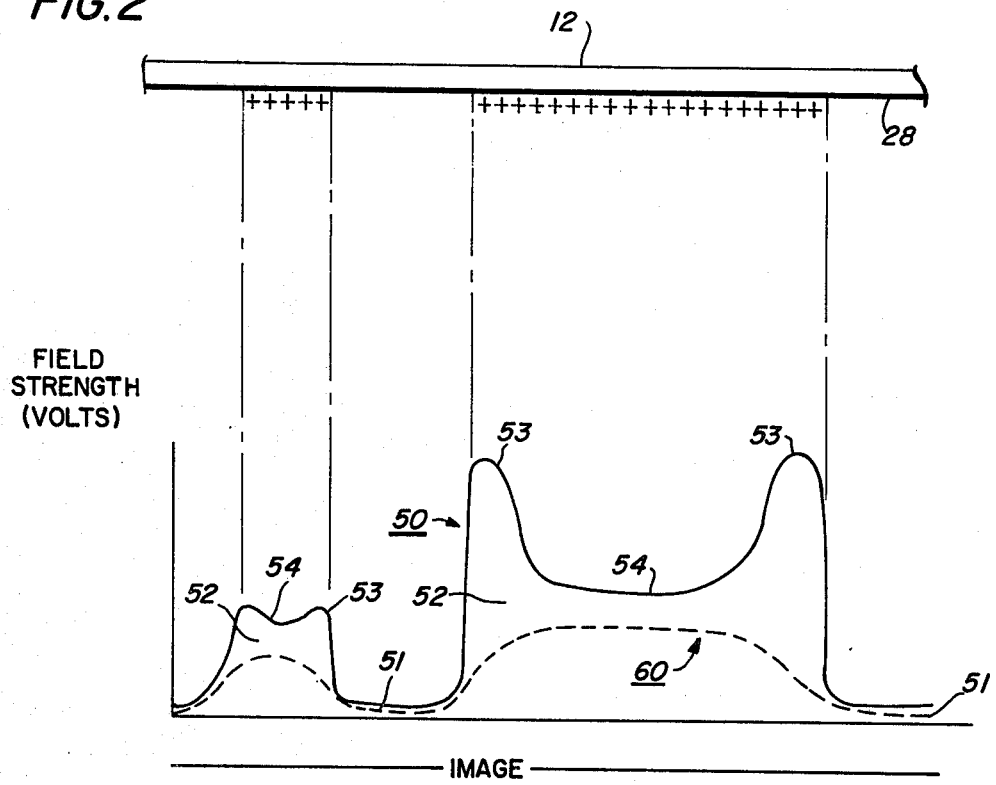
Figure 3:
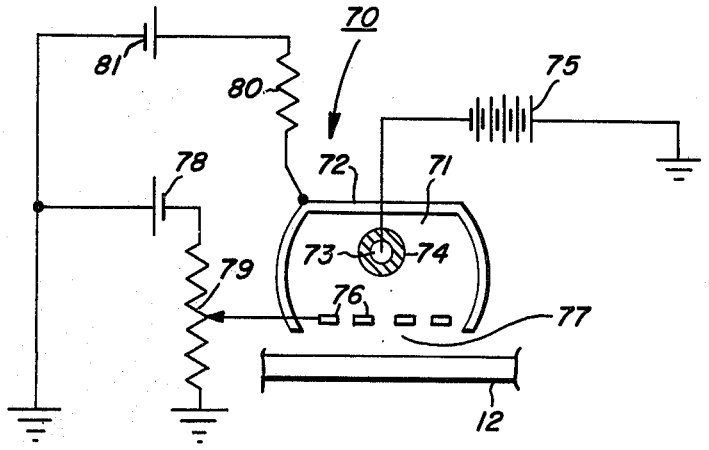

Other objects and advantages will be apparent from the ensuing description and drawings, in which:

FIG. 1 is a diagramatic view in partial cross section of an exemplary xerographic machine embodying the principles of the present invention;

FIG. 2 is a graph plotting exposure time versus image charge voltage for an exemplary electrostatic latent image along a random section of the xerographic machine photoconductive member comparing unregulated charge levels with charge levels regulated in accordance with the present invention; and FIG. 3 is an enlarged view in cross-section showing details of the field effect regulator of the present invention.

Referring to FIG. 1 of the drawings, there is shown an exemplary xerographic machine, designated generally by the numeral 10, embodying the principles of the present invention. Referring thereto, machine 10 has a drum type photoconductor 12 with a series of processing stations disposed about the periphery thereof as follows:

A charging station 14, at which a uniform electrostatic charge is deposited on the photoconductive layer of the drum 12 by a suitable corona generating means, such as corotron 15;

An exposure station 16, at which the light or radiation pattern of copy to be reproduced is projected onto the photoconductive surface 28 of drum 12 to selectively dissipate, in accordance with the copy image pattern, the charge on the drum surface to thereby form a latent electrostatic image of the copy to be reproduced;

A development station 18, at which a xerographic developing material including toner powder having an electrostatic charge opposite to that of the latent electrostatic image on the photoconductive surface of drum 12 is brought into contact with the drum surface, the toner powder adhering to the latent electrostatic image to form a xerographic powdered image in the configuration of the copy being reproduced;

A transfer station 20, at which the xerographic powdered image in electrostatically transferred from the drum surface to a suitable support surface such as web 21; and A drum cleaning station 22 at which the surface of drum 12 is brushed to remove residual toner particles remaining thereon after image transfer.

A suitable fixing device or fuser 26 is provided to permanently fix the toner image on web 21.

The aforesaid stations are operatively disposed about the xerographic drum 12 upon which the images are to be formed. The photoconductive or xerographic surface 28 of drum 12 may comprise any suitable photoconductive material such as selenium. Shaft 29 of drum 12 is suitably supported for rotational movement, suitable drive means (not shown) being provided to turn drum 12 in the direction indicated by the solid line arrow as well as for initiating the cycle of operation for the various processing stations described heretofore. While a drum type photoconductor has been illustrated other photoconductor types such as a belt, may instead be contemplated.

The developing components of development station 18 are encased in a housing 30, the lower or sump portion 31 of which holds a quantity of two component developing material. The developing material is raised to an elevated position and cascaded down onto the xerographic surface of drum 12 by a series of buckets 32 carried by belt 34. Belt 34 is itself supported rollers 35. Power may be imparted to the rollers by any conventional power source, not shown, to move the buckets in the direction as indicated by the arrows.

As the buckets reach their uppermost position, they are adapted to discharge the developing material through a pair of plates 37, 38 which guide the material onto the surface 28 of drum 12. Sump 31, buckets 32, and plates 37, 38 extend a width approximately equal to the width of drum 12 to insure the cascading of developing material across the entire width of the photoconductive surface 28. As the developing material cascades down the arc of drum 12, the latent electrostatic image on the drum surface 28 is developed. As the developing material passes the horizontal center line of drum 12, the effect of gravity carries unused developing material onto the pick off baffle 39 which guides the material back into the sump 31 for recycling. A toner dispenser (not shown) may be provided with developer housing 30 for supplementing the toner given up by the developing material through development of images.

In operation, the photoconductive surface 28 of drum 12 is normally charged to a predetermined positive level by corotron 15 following which the charged photoconductive surface is exposed at exposure station 16 to a light reflected image of the original being copied. Such exposure results in selective discharge of the photoconductive surface 28 in conformance with the image presented by the original on the photoconductive surface as described earlier. The photoconductive surface, bearing the latent electrostatic image is thereafter, developed at development station 18. Toner in the developing material, which in the present example is negative, is electrostatically attracted to and held on the photoconductive surface 28 by the positive charges thereon, the intensity of such charges being in accordance with and in proportion to the image outline. The developed image is thereafter transferred to web 21 following which the image on web 21 is fixed by fuser 26 to render the image permanent.

Referring now to the graph of FIG. 2, a segment of a latent electrostatic image created through exposure of the original being copied at exposure station 16 is there represented by the solid line 50. As can be seen, the exemplary exposure pattern represented by line 50 comprises exposed, i.e., non-image, and unexposed or partially exposed, i.e. image, areas 51, 52. Due to edge effect phenomena, the boundary charge level (represented by line 50) of the image areas 52 is higher along the image periphery, i.e. peaks 53, than along the image interior, i.e. valleys 54, the extent of this charge differential normally increasing with increased image area and/or intensity. This charge differential between peaks 53 and valleys 54 results in a non-uniform electric field having a greater strength in the vicinity of the image periphery than at the image interior. As a result, a disproportionally greater amount of toner is attracted to the vicinity of peaks 53 than to valleys 54 with the result that the image border is heavily developed whereas the image interior may be only marginally or weakly developed. This results in solid areas which appear white or light colored in the center.

If, however, charge peaks 53 could be reduced or even neutralized, i.e., flattened, then toner would be attracted to the latent electrostatic image in accordance with an image charge pattern and unaffected by varying electric fields.

Referring now to FIGS. 1 and 3, the field neutralizer of the present invention is designated by the numeral 70 and is disposed downstream of exposure station 16 and before development station 18. Neutralizer 70 has an exterior housing 72 which is comprised of an electrically conductive material having a configuration, when viewed in cross-section, of inverted U-shape. The length of housing 72 is preferably slightly greater than or equal to the width of drum 12, neutralizer 70 being mounted to extend in transverse spaced relationship thereto. One or more wire-like ion discharge devices, herein illustrated as corona discharge wire 73, is supported within the confines 71 of housing 72 in predetermined spaced relationship with the sides thereof. The support means for corona discharge wire 73 includes suitable insulators 74 to electrically isolate wire 73 from the conductive housing 72. Corona discharge wire 73 is electrically connected to a suitable high voltage power supply 75. Power supply 75 may be either a DC or AC power unit. In the exemplary arrangement shown, power supply 75 comprises a high voltage negative DC source.

A lattice-like ion control grid 76 is disposed across the open side or mouth 77 of housing 72 athwart the discharge path for ions generated by corona wire 73. Grid 76, which is formed of a conductive material and suitably supported across the mouth 77 of housing 72, is electrically insulated therefrom. Grid 76 is electrically connected to a suitable source of control voltage, illustrated herein by battery 78, via adjustable control resistor 79. As will appear, voltage source 78 imposes a controlled negative bias on grid 77 to regulate the egress or discharge of ions generated by the corona discharge wire 73 therefrom.

To facilitate control over the quantity of charged ions accumulated within the confines of housing 72, housing 72 may be suitably biased. For this purpose, a relatively low potential power source, exemplified by battery 81 is provided. Battery 81 is connected through resistor 80, which is preferably adjustable, to housing 72.

In the exemplary xerographic machine illustrated, corotron 15 charges the photoconductive surface of drum 12 to a suitable positive voltage. Corona discharge wire 73 of field effect neutralizer 70, which is coupled to power supply 75, produces negatively charged ions. A controlled negative bias is placed on grid 76 to regulate the outflow of ions from chamber 71 of housing 72. At the same time, a relatively low positive bias may be applied to housing 72 to limit the accumulation of ions within the chamber 71.

Following charging by corotron 15, drum 12 is exposed at exposure station 15. The resulting latent electrostatic image normally includes areas at different positive charge levels as exemplified in FIG. 2 the exact pattern depending upon the content of the original being copied. The electric fields generated from the various charge levels that comprise the latent electrostatic image attract, in accordance with their individual intensity, negative ions from chamber 71 of the field effect neutralizer 70. The quantity of ions drawn from chamber 71, as will be understood, is dependent principally upon the strength of the charge on the photoconductive surface 28, the restrictive effect of grid 76 which in turn is controlled by the level of bias applied thereto, and the available supply of ions in chamber 71 which may be regulated by the bias applied to housing 72 as well as the power input to corona discharge wire 73. These negative ions, which as described above are drawn from chamber 71 of field effect neutralizer 70 in relation to the strength of the electrostatic image charge adjacent thereto, tend to be attracted to and neutralize the higher level charges that comprise the latent electrostatic image, particularly charge peaks 53. This results in a more uniform electric field devoid of or with reduced charge peaks such as illustrated by the dotted line 60 in FIG. 2. At the same time an over supply of neutralizing ions, which could weaken or even erase the latent electrostatic image, or portions of the image, is avoided through the control exercised by grid 76.

By properly setting the value of resistor 79 and thereby the bias potential of grid 76, the operational level of field effect neutralizer 70, and hence the neutralizing effect on the latent electrostatic image can be controlled to provide optimum neutralizing effect.

It will be understood that the voltage inputs, and polarities of grid power source 78 and shield power source 81 are tailored to the type and intensity of charge applied to the photoconductive member 12 by corotron 15 to provide optimum development without washout of the image solid areas. In this context, housing 72 of field effect neutralizer 70 may be grounded through a suitable resistor such as resistor 80. Alternately, the polarity of the bias imposed on housing 72 may be the same as that of the ions generated by corona discharge wire 73.

While the invention has been described with reference to the structure disclosed, it is not confined to the details set forth, but is intended to cover such modifications or changes as may come within the scope of the following claims.

What is claimed is:

1. In an electrostatic reproduction machine having a photoconductive member, the combination of:

charging means to charge said photoconductive member in preparation of imaging exposure means to expose said charged photoconductive member to selectively discharge said photoconductive member and form a latent electrostatic image on said photoconductive member in accordance with the original being reproduced;

means forming a reservoir of charged ions, said ions being charged opposite from said photoconductive member charge whereby charges left on said photoconductive member and comprising said latent electrostatic image tend to attract oppositely charged ions from said reservoir in accordance with the charge level of the charges left on said photoconductive member and thereby reduce peak charge levels remaining on said photoconductive member; and control gate means for regulating the flow of ions from said reservoir to said photoconductive member.

2. The reproduction machine according in claim 1, in which said reservoir forming means includes an enclosure spaced adjacent said photoconductive member, and at least one corona generating element within said enclosure, said enclosure having an opening for the passage of ions from said enclosure to said photoconductive member; said control gate means being disposed astride said ion passage to control the flow of ions to said photoconductive member.

3. The reproduction means according to claim 2 including means to limit the quantity of said ions in said housing.

4. The reproduction machine according to claim 2, in which said control gate means comprises a perforate grid member disposed across the mouth of said opening, and means to establish a pre-selectable bias on said grid.

5. The reproduction machine according to claim 2, in which said control gate means includes a grid, and means to bias said grid to the same polarity as said ion charge.

6. In an electrostatic reproduction machine having a photoconductive member on which latent electrostatic images on the original being copied are generated, the combination of a charge corotron for charging said photoconductive member to a relatively high voltage of predetermined polarity in preparation for imaging means to expose said charged photoconductive member to the original being copied whereby to form on said photoconductive member a latent electrostatic image of said original, said latent electrostatic image being defined by charges of various voltage magnitude means adapted to reduce areas of higher charge and level off said latent image defining charges to enhance solid area coverage, said charge control means including a source of ions charged to a polarity opposite said photoconductive member predetermined polarity downstream of said exposure means, a sump for storing said ions, and valve means for releasing said charged ions from said sump at a present rate, charged ions released from said sump being drawn to said photoconductive member to effect a disproportionate reduction of higher charge areas and enhance reproduction of image solid areas.

* * * * *